US007645417B2

(12) United States Patent
Lecomte et al.

(10) Patent No.: US 7,645,417 B2
(45) Date of Patent: Jan. 12, 2010

(54) METHOD AND DEVICE FOR COOLING A STEEL STRIP

(75) Inventors: Stéphane Lecomte, Berloz (BE); André Fouarge, Liege (BE); Denis Bouquegneau, Saint-Georges-sur-Meuse (BE)

(73) Assignee: Arcelor France (FR)

( * ) Notice: Subject to any disclaimer, the term of this patent is extended or adjusted under 35 U.S.C. 154(b) by 263 days.

(21) Appl. No.: 11/442,934

(22) Filed: May 30, 2006

(65) Prior Publication Data

US 2006/0243357 A1 Nov. 2, 2006

Related U.S. Application Data

(63) Continuation of application No. PCT/BE2004/000167, filed on Nov. 25, 2004.

(30) Foreign Application Priority Data

Dec. 1, 2003 (EP) ..... 03447278

(51) Int. Cl.
*C21D 1/62* (2006.01)

(52) U.S. Cl. ..... 266/113; 266/131

(58) Field of Classification Search ..... 266/112, 266/113, 131
See application file for complete search history.

(56) References Cited

U.S. PATENT DOCUMENTS

| | | | | |
|---|---|---|---|---|
| 3,724,826 | A | 4/1973 | Kubotera et al. | |
| 4,052,235 | A | 10/1977 | Nakaoka et al. | |
| 4,065,329 | A | 12/1977 | Paulus et al. | |
| 4,113,523 | A | 9/1978 | Uchida et al. | |
| 4,838,526 | A * | 6/1989 | Iida | 266/113 |
| 6,305,176 | B1 * | 10/2001 | Matsuda et al. | 266/113 |

FOREIGN PATENT DOCUMENTS

| | | |
|---|---|---|
| EP | 0086331 A1 | 8/1983 |
| EP | 0210847 A2 | 2/1987 |
| EP | 1300478 A1 | 4/2003 |
| JP | 55110739 | 8/1980 |
| JP | 56072128 | 6/1981 |
| JP | 57085923 | 5/1982 |
| JP | 60009834 | 1/1985 |
| JP | 62238334 | 10/1987 |

(Continued)

OTHER PUBLICATIONS

The Iron and Steel Institute of Japan (ISIJ), Cold Rolled Steel Sheets-Technology and Products in Japan-, Book, Institute Book Serial No. No. 7016, Mar. 21, 2001, 4 pages double sided, The Iron and Steel Institute of Japan Tokyo Japan.

(Continued)

*Primary Examiner*—Scott Kastler
(74) *Attorney, Agent, or Firm*—Reinhart Boerner Van Deuren P.C.

(57) ABSTRACT

The present invention relates to a cooling device for a quenching operation during a continuous annealing treatment of a flat product in a form of a metal strip. The cooling device includes an overflow weir and a series of tubes ejecting a cooling fluid onto the strip, wherein the tubes are separated by a gap allowing evacuation of the cooling fluid via the gaps.

5 Claims, 5 Drawing Sheets

FOREIGN PATENT DOCUMENTS

| | | |
|---|---|---|
| JP | 63145722 | 6/1988 |
| JP | 11193418 | 7/1999 |

OTHER PUBLICATIONS

D. Bouquegneau, A. Fourage, V.Lhoist (Cockerill Sambre, Groupe Arcelor) J. Crahay, P.Klinkenberg, P.Simon (CRM), Production of ultra high strength steels by Turbulent Water Immerse Cooling Equipment (TWICE), Aug. 2003, 5 pages double sided, vol. 2003, No. 07-08.

International Search Report, International Application No. PCT/BE2004/000167, date of actual completion of the international search report Jan. 17, 2005, date of mailing of the international search report Jul. 7, 2005, 5 pages double sided, European Patent Office.

International Preliminary Report on Patentability (translation), International Application No. PCT/BE2004/000167, date of actual completion of the corresponding international search Jan. 17, 2005, date of actual mailing of the corresponding international search report Feb. 7, 2005, 6 pages, European Patent Office.

* cited by examiner

METHOD AND DEVICE FOR COOLING A STEEL STRIP

CROSS-REFERENCE TO RELATED PATENT APPLICATIONS

This patent application is a continuation of International Application No. PCT/BE2004/000167, filed Nov. 25, 2004 claiming priority to European Patent Application No. 03447278.7 filed Dec. 1, 2003, the teachings and disclosure of which are hereby incorporated in their entireties by reference thereto

FIELD OF THE INVENTION

The present invention relates to a device for cooling a steel strip in the context of a continuous annealing method. In particular, this cooling is achieved by means of immersed jets of water. This cooling operation may be carried out following a first cooling operation in a bath of boiling water.

STATE OF THE ART

Continuous annealing is a thermochemical treatment that is applied to strips of steel after cold rolling. The "strip" of metal is the metal product which, when cut, produces sheets used in particular for the manufacture of car bodywork, the frames of household electrical appliances, etc.

The method of continuous annealing consists in passing the steel strip through a furnace where it is exposed to controlled heating and cooling. In the continuous annealing furnace, the steel strip moves vertically according to a series of successive ascending and descending paths and it thus sequentially passes through the various treatment stages.

The treatment of the strip in the furnace generally comprises the following successive thermal stages:

- preheating and heating: the strip reaches a temperature between 700 to 850° C. in 2 to 3 minutes;
- keeping at maximum temperature for about 1 minute;
- slow cooling, for example with boiling water;
- rapid cooling (called "quenching"), for example by water in liquid form sprayed over the strip at a temperature that may be as high as its boiling point.
- overageing;
- final cooling.

These different stages are required to implement the steel treatment intended, namely recrystallisation, precipitation of the carbides, obtaining final structures or even obtaining a non-ageing steel, etc.

In particular, a growing demand emerged in recent years, especially from the automobile industry, for steel sheets which simultaneously have improved properties of resistance and formability.

In this context, the cooling phase plays a particularly crucial role since it allows, in some cases, to reduce the concentration in expensive alloy elements needed for achieving particular microscopic structures such as, for instance, "dual phase," multiphase, "HEL" (high elastic limit), etc types. The cooling method therefore corresponds to a matter of metallurgical and financial interest that is not insignificant.

The main cooling technologies used in industry are:

- cooling by gas jets;
- immersion in a bath of water, possibly "stirred";
- cooling by passing over cooled rollers;
- cooling by jets of water;
- cooling by a mist of water created by means of atomisation with a supersonic gas, this technology being referred to as "misting jet."

In the past, the Applicant developed a cooling method that consists in immersing the steel strip in a bath of water close to its boiling temperature. Although this method is characterised by an exceptional homogeneity of cooling and by a constant coefficient of heat transfer, irrespective of the conditions on the line, it also has some limitations.

For one thing, the cooling rates that are possible to achieve are relatively low, namely about 50° C./s for a steel strip of 1 mm thickness. This limitation arises from the fact that when a steel strip is immersed at high temperature into a bath of boiling water, a film of stable steam is formed near its surface in a condition known as "film boiling," which considerably limits thermal exchanges. By "film boiling" is meant the presence of a vapour film, caused by high boiling, between a hot wall and a fluid that is either a liquid or a diphasic mixture of liquid and vapour, this presence resulting in poor heat transfer between the wall and the fluid.

For another thing, the temperature of the steel strip upon exit from the bath of boiling water must remain higher than about 300° C. When the temperature of the strip falls below this temperature, the vapour film becomes unstable and passes to a boiling condition known as "nucleated" boiling. In the latter condition, areas neighbouring the strip are subjected to different heat flows, which creates major temperature differences. These temperature gradients introduce mechanical constraints into the steel that risk creating plastic deformations that will thus be permanent and will lead to flatness defects.

Solutions have been proposed to correct these defects. The steel strip can for instance be immersed in a static bath of cold water. But this solution also leads to the appearance of defects in flatness.

Other solutions have been put forward that consist in cooling the steel strip by means of immersed jets so as to prevent the local formation of boiling zones in its vicinity. These cooling systems may be or may not be preceded by slower cooling of a "gas jet cooling" type or by immersion in a static bath of water.

Thus, in patent application JP-A-58 039210, the strip is first cooled in a bath of water at a temperature that is higher than 60° C., until it reaches a temperature between 200 and 500° C., i.e. the range of temperatures in which the transition between film boiling and nucleated boiling occurs. It is then recommended to cool the strip just before or just after the transition by means of immersed water jets until the strip reaches the temperature of the bath.

A similar solution (JP-A-60 009834) uses a set of cooling ramps arranged on each side of the steel strip and immersed in a tank of water at a temperature between 60 and 75% of the boiling temperature. For a given configuration of spray ramps, a laminar flow is generated, which allows to prevent the formation of a vapour film in the vicinity of the steel strip.

Yet another solution consists in circulating water between two flat plates parallel to and at counter-current relative to the motion direction of the strip (EP-A-210847, JP-A-63 145722, JP-A-62 238334).

Another document proposes using the impact pressure of the jets to suppress the deformations of the strip during quenching (see JP-A-11 193418). The Applicant recommends applying a pressure of at least 500N/cm$^2$ to each side of the steel strip.

Lastly, it is also possible to control the cooling by means of additives in the quenching bath in such a way as to prevent boiling and thus to limit the level of inner constraints in the steel during quenching (JP-A-57 085923).

Although numerous solutions have been proposed, simultaneously obtaining high thermal performance and a good level of flatness upon exit from rapid cooling by liquid means remains a major challenge to this day.

Document EP-A-1 300 478 describes a continuous cooling method for a steel strip in the context of a continuous annealing treatment, in which the strip is subjected to at least the following operations:

- the strip undergoes an first "slow" cooling of the "boiling water" type and a second "rapid" cooling with water or quenching;
- between these two cooling operation, the strip passes through a lock or sealing device to ensure controlled transition, preferably with regard to pressure and temperature, between the first slow cooling and the second rapid cooling whilst suppressing or reducing water leaks in the direction of the first cooling operation towards the second and vice versa;

the succession of these three operations being carried out in such a way that the time that passes between any two successive operations is as short as possible, preferably zero.

Aims of the Invention

The present invention aims to provide a "quenching" operation, typically at a speed greater than 1,000° C./s, applicable to flat metal products, preferably made of steel, in the form of cold-rolled strips.

This quenching operation must be implemented by means of jets of cold water at a temperature preferably between 0° C. and 50° C., said jets being immersed.

The invention aims to ensure cooling conditions at high power that are as homogeneous as possible across the entire width of the steel strip by controlling the flows within the device.

Thus the temperature of the strip upon entry in the device must be between 750° C. and 350° C. and the temperature upon exit must preferably be between 0° C. and 150° C.

Main Characteristic Elements of the Invention

One first object of the present invention relates to a basic cooling device to perform a quenching operation during the continuous annealing treatment of a flat product in the form of a metal strip, preferably a steel strip, said device being positioned in an essentially vertical, ascending or descending path, comprising an overflow weir in which a series of tubes are completely immersed, stacked more or less vertically and symmetrically along either side of the strip and which eject each, in the form of turbulent jets more or less horizontally, a cooling fluid onto the strip through a slit or a series of holes. The device is also provided in its lower part with a sealing means.

According to the invention, any two successive tubes located on a same side of the strip are separated by the same gap for all tubes with a view to evacuate the cooling fluid. Said gap is then selected at a specific flow rate level for the cooling fluid, expressed in cubic meters per hour and per square meter of surface of the strip so as to minimise the loss of flow in the evacuation channels corresponding to said gap (the loss of flow for each gap and the total loss of flow are identical).

According to a preferred embodiment of the invention, the wall of the overflow weir, located behind the tubes, has a width that is at least equal to that of the tubes and the horizontal distance of this wall relative to the back of the tubes is selected so that the loss of flow caused by the presence of the overflow weir is less than 5% of the loss of flow caused by the gaps between two successive tubes, which is considered negligible. The flow is therefore two-dimensional.

The invention advantageously allows to prevent the phenomena of local boiling by choosing a specific flow rate for the cooling fluid on a surface of the strip between 250 and 1,000 $m^3$ per hour and per $m^2$. In an example of device tested by the Applicant, the maximum specific flow rate per surface was around 580 $m^3$ per hour and per $m^2$.

The loss of flow caused by the gaps is preferably less than a 150 mm column of water.

As a further advantage, the distance between the end of each tube and the strip is identical for all tubes and it is between 50 mm and 200 mm.

Still according to the invention, the ejection speed ($V_{JET}$) satisfies the following criteria, respectively:

for the holes, $$V_{JET} \geq 0{,}1\frac{A}{d},$$

for the slits, $$V_{JET} \geq 0{,}25\left(\frac{A}{d}\right)^{\frac{1}{2}},$$

where A represents the distance between the tube and the strip and d represents the diameter of a hole or the thickness of the slit. A and d are expressed in the same units of length, in meters for example. Their quotient is dimensionless. $V_{JET}$ is expressed in m/s.

These two criteria taken from the theory of turbulent jets, indicates the attenuation of the maximum speed of a turbulent jet with an environment at speed 0. The criteria are calculated on the basis of a minimum speed of 2.5 m/s. The maximum speed of the jet at A=50 mm (position of the strip relative to the jet aperture) is 0.65 m/s. The speed of 0.65 m/s is thus considered the minimum speed of the jet when it reaches the strip, so as to break the layer of film boiling.

The cooling fluid is preferably liquid water maintained at a temperature below 50° C.

The device is preferably located in an essentially vertical ascending path (angular difference relative to the vertical lower than 30° C.) whilst being directly preceded by a tank of water brought more or less to boiling point.

The invention will also be implemented to an advantage in an installation where the metal product to be treated has a motion speed between 0.25 m/s and 20 m/s and a thickness between 0.1 mm and 10 mm.

One important characteristic of the invention lies in the fact that the cooling tubes are sized so that the ejection speed of the cooling fluid is homogeneous across the entire width of the strip.

The tubes are preferably sized so that the distribution of speeds is such that there is a relative difference between the maximum speed ($V_{max}$) and the minimum speed ($V_{min}$) of ejection depending on the width of the lower tube of less than 5% or $$\frac{V_{max} - V_{min}}{V_{max}} \leq 0{,}05.$$

The ratio between the section for passage of a tube and the free spray section of that tube, i.e. the area of the slit or the total area of the holes, is greater than 1.

According to a preferred embodiment of the invention, said tubes have a rectangular section. The ratio of one side to an adjacent side of the rectangular section is preferably between 0.1 and 10 and the thickness of the tubes is between 0.25 and 10 times the diameter of the holes or the thickness of the slit so as to control the coherence of the jet, the ratio between the thickness of the tubes and the diameter of the holes preferably also being equal to ⅔.

According to another advantageous characteristic of the invention, the above-mentioned sealing means comprises a lock with a double pair of rollers allowing both the passage of the strip and the creation of a loss of flow limiting to a minimum value the leaks from the overflow weir downwards.

Still according to the invention, this sealing means also includes a means for injecting a fluid between the rollers at a controllable pressure and/or temperature.

As an advantage, the upper tube is provided with a block whose height is at least equal to the total of the thickness of the film of water in the overflow weir and of the height of the water column corresponding to the loss of flow between the tubes at maximum flow rate.

A second object of the present invention relates to a quenching method during the continuous annealing treatment of a flat product in the form of a metal strip, preferably a steel strip, implementing the device described under one of the above embodiments, to achieve a specific cooling power between 1,000 kW/m$^2$ and 10,000 kW/m$^2$ per surface of metal product.

According to the method of the invention, the temperature of the strip upon entry in the device is between 350° C. and 750° C. and the temperature upon exit is between 50° C. and 450° C., preferably between 50° C. and 100° C. or between 350 and 450° C.

BRIEF DESCRIPTION OF THE FIGURES

FIG. 5 relates to a steel of the "dual phase" family, whereas FIG. 6 relates to a steel of the multiphase steels family.

FIG. 8 indicates the parameters allowing to calculate the flatness index, these parameters defining the sine curve to which the longitudinal profile of the strip is fitted edge on.

DESCRIPTION OF A PREFERRED EMBODIMENT OF THE INVENTION

Figure 1:
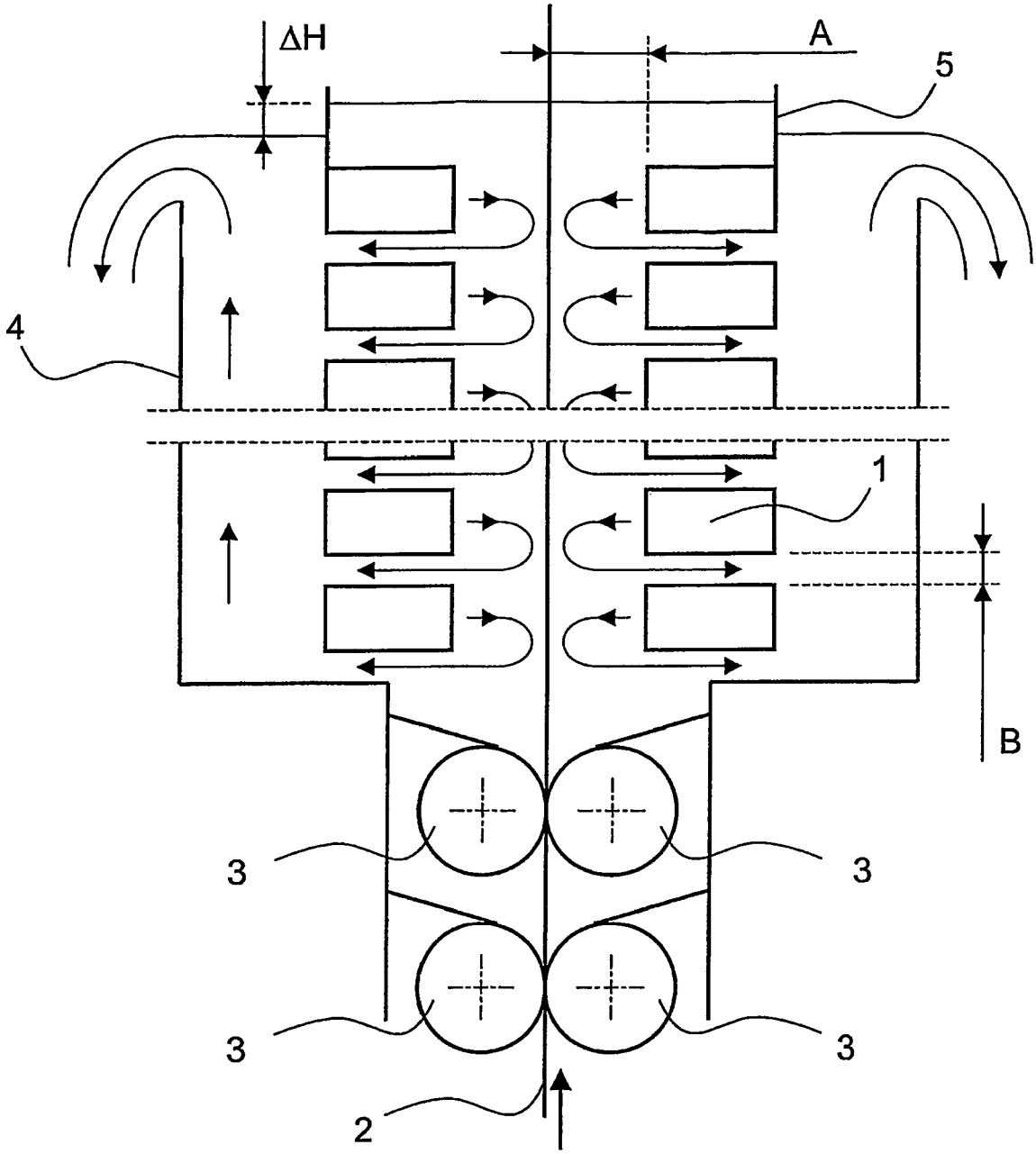
FIG. 1 schematically shows a sectional view of the cooling device according to the present invention.

As FIG. 1 shows, the cooling device comprises a set of tubes 1 called "ramps" or "cooling ramps" arranged symmetrically on each sides of the steel strip to be cooled. These ramps are immersed and laterally supplied with cooling fluid. Their sections are preferably rectangular. When further describing the invention, the terms "tubes" and "ramps" will be used without distinction.

The immersion of the ramps is achieved by means of a sealing system, located in the lower part of the device, that allows both the passage of the steel strip 2 and the creation of a maximum flow loss so as to limit to a minimum the leakage rate of the cooling fluid towards the bottom of the housing. In the application presented, this sealing system comprises a double pair of rollers 3 pressed against the steel strip and positioned symmetrically relative to the latter. Between the rollers, a fluid is injected with a controllable pressure and/or temperature.

The cooling fluid is preferably water. The cooling ramps are located at a distance A from the passing line of the strip 2. For reasons of bulk for one thing and for another in order to limit the total flow rate in the system, for equivalent performance, the maximum distance between the strip and the cooling ramps is set to 200 mm.

A space B is left between two successive ramps so that the water injected by the ramps can be evacuated between them. This guarantees a flow as homogeneous as possible depending on the width of the steel strip. The choice of the distance B arises from a compromise between the maximum specific cooling power P, the specific power being defined as the cooling power per unit of surface area and per surface of the strip to be cooled, and a minimum loss of flow through the evacuation channels so as to ensure sufficiently rapid replacement of the cooling fluid in the vicinity of the strip and thereby to prevent the formation of local boiling zones in the vicinity of the strip. Distance B is chosen as identical between two pairs of successive ramps for all the ramps, so as to ensure identical flow conditions in front of each spray ramp. This therefore allows to achieve vertical homogeneity of the flow. In this way, the cooling fluid injected by a given ramp is evacuated by means of channels located right next to this ramp. This prevents the creation of favoured paths and minimises the time that the cooling fluid spends in the vicinity of the strip, still in order to prevent local formation of boiling zones.

Figure 2:
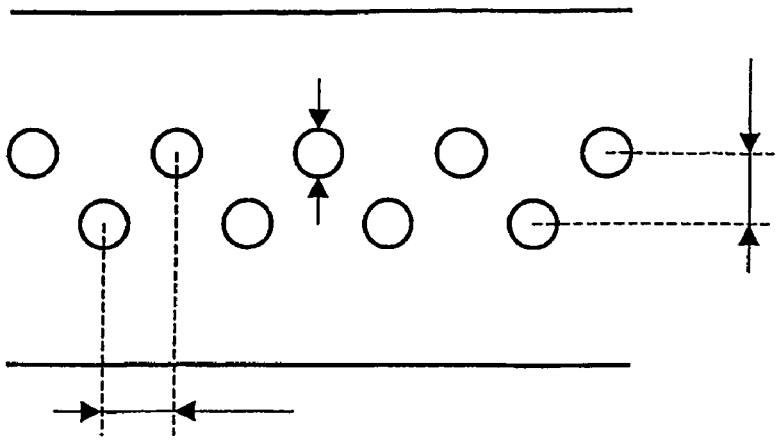
FIG. 2 schematically shows an arrangement of the holes intended for spraying water onto the steel strip in the device of the present invention.

Each cooling ramp 1 is provided on its surface exposed to the strip with at least one slit or a series of holes, as shown in FIG. 2, intended for spraying cooling fluid onto the strip. The distance between two successive holes must be such that the flow in the close vicinity of the strip may be matched to that of a slit. The ejection speed of the fluid must be sufficient to prevent the formation of boiling zones in the vicinity of the strip. This ejection speed V is chosen as a function of the distance A relative to the strip and it is typically between 0 and 10 m/s.

Downstream from the evacuation channels, the cooling device or housing comprises an overflow weir 4 across the entire width of the housing and whose height corresponds to the level of the jet of the last ramp, which guarantees that in all operation conditions, the last ramp will be immersed to the same extent as the others.

In order to ensure identical flow conditions in front of each ramp:

the upper cooling ramp is surmounted by a block 5 whose height is at least equal to the total of the thickness H of the strip of water in the overflow weir and of the height of water column ΔH corresponding to the loss of flow ΔP through the evacuation channels, for the maximum flow rate Qmax;

an evacuation channel is provided under the last ramp.

Thus, when the system is operating, there is a difference of water level between the front surface or strip side, and the back surface or weir side, of the ramps. This difference is equal to the height of the column of water corresponding to the loss of flow between two ramps, for a given flow rate.

Figure 3:
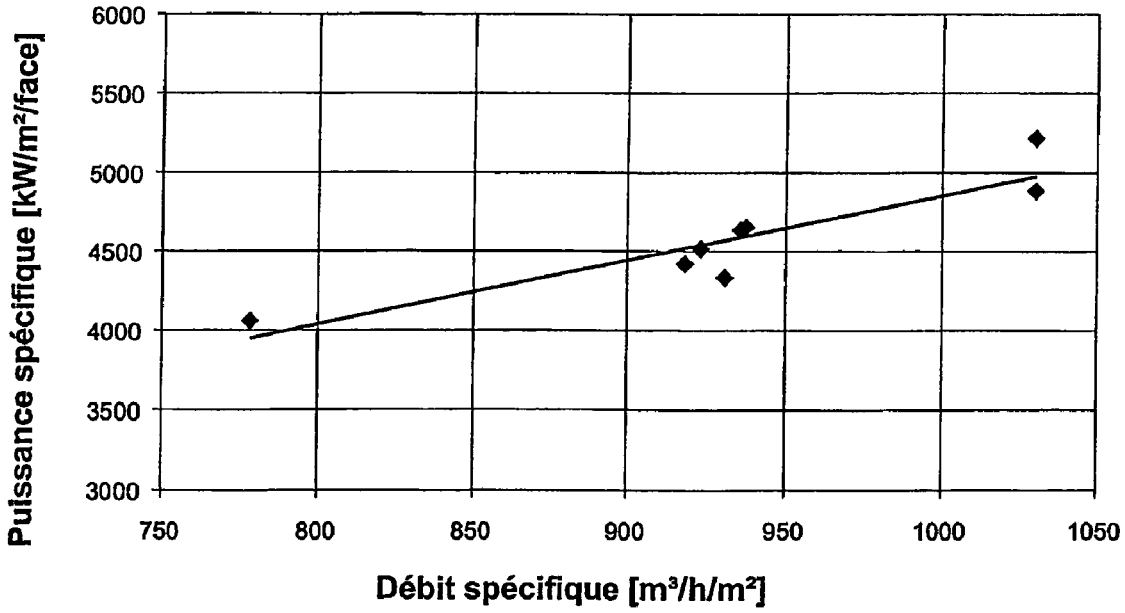
FIG. 3 graphically shows the thermal performance of the cooling device according to the invention.

The cooling performances of the device shown in FIG. 3 were measured in industrial conditions by thermal balance on the basis of the following values: temperatures of the steel strip upon entry in and exit from the device, length of the cooling section and motion speed of the steel strip through the device. FIG. 3 shows that the specific cooling power, expressed in kW per square meter and per surface of the strip, is a linear function of the specific flow rate, itself expressed in cubic meters per hour and per square meter for the two surfaces added together. In the conditions envisaged here, the specific power is between 4,000 and 6,000 kW/m$^2$ and per surface of the product.

Figure 4:
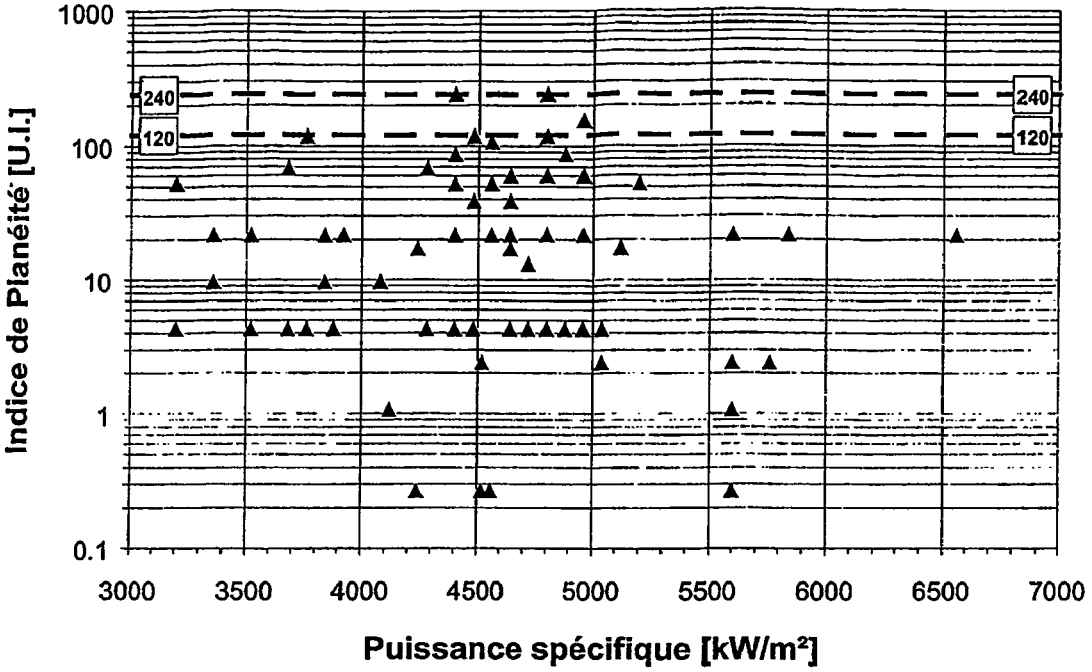
FIG. 4 shows the performance of said device in terms of flatness of the steel strip.

FIG. 4 shows the performance of the device with regard to the flatness of the steel strip. They represent the homogeneity of the cooling and hence the control of the flows in the device. The determination of flatness relates here to long edges. Each point in the figure shows an operation point of the device—defined by the associated specific cooling power—at a given moment during the series of industrial trials. A flatness index, expressed in "I" units, is associated with each operation point. An "I" unit corresponds to a relative elongation of 1 mm per 100 m of steel strip.

Figure 8:
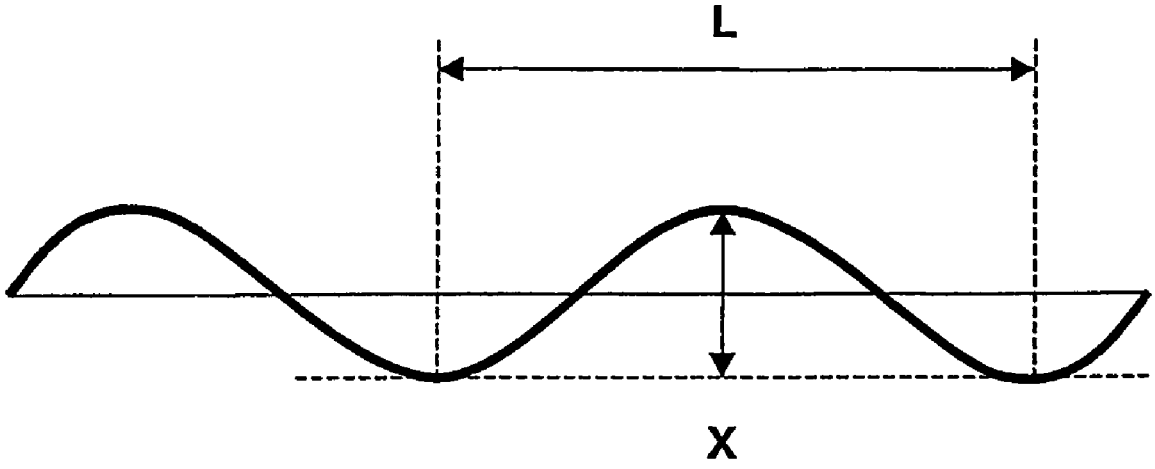

In the event of a defect of a "long-edge" type, the longitudinal profile of the strip edge on can be assimilated to a sine curve with a wavelength L and an amplitude X. The flatness index is calculated on the basis of the measurements of L and X (see FIG. 8) by means of the following relationship:

$$\frac{\Delta L}{L}\cdot 10^5[I] = \left(\frac{X[\mathrm{mm}]}{2\cdot L[\mathrm{m}]}\right)^2.$$

FIG. 4 shows two reference thresholds, 120 and 240 "I" units, that correspond to the flatness tolerances admissible for two electrogalvanisation lines. The figure shows that the majority of the operation points are located below the threshold of the more exacting line.

Figure 5:
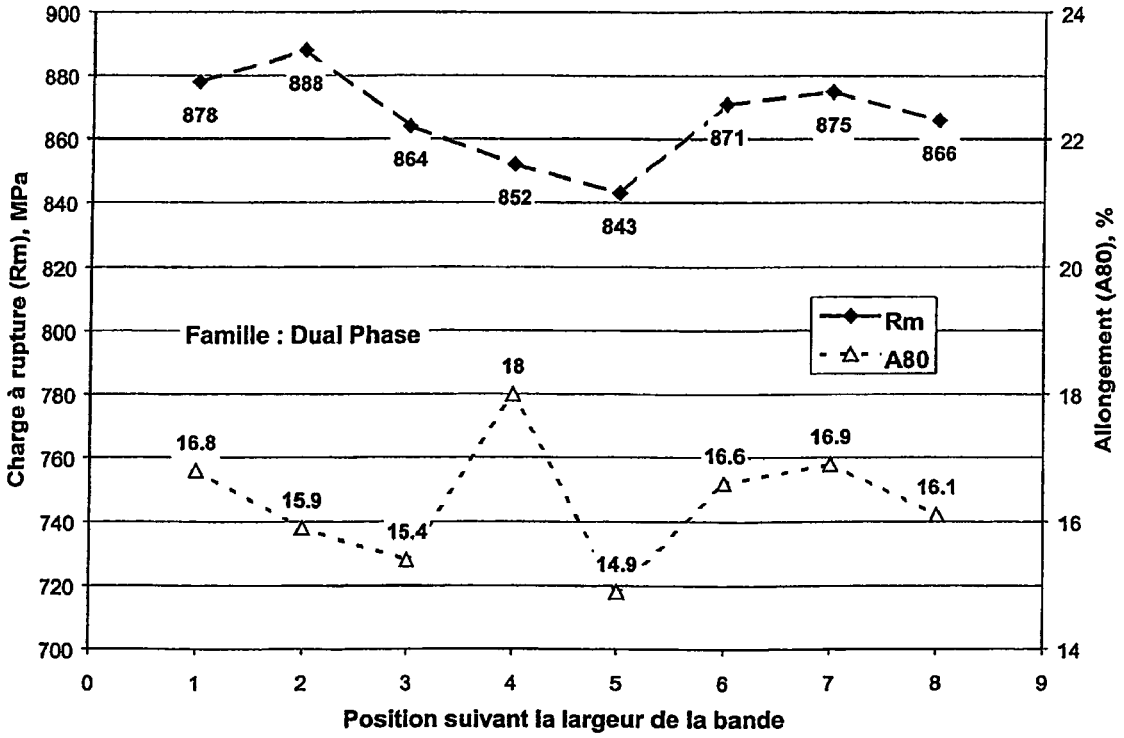
FIGS. 5 and 6 show the impact of the cooling uniformity on the homogeneity of the mechanical properties of the steel strip.
Figure 6:
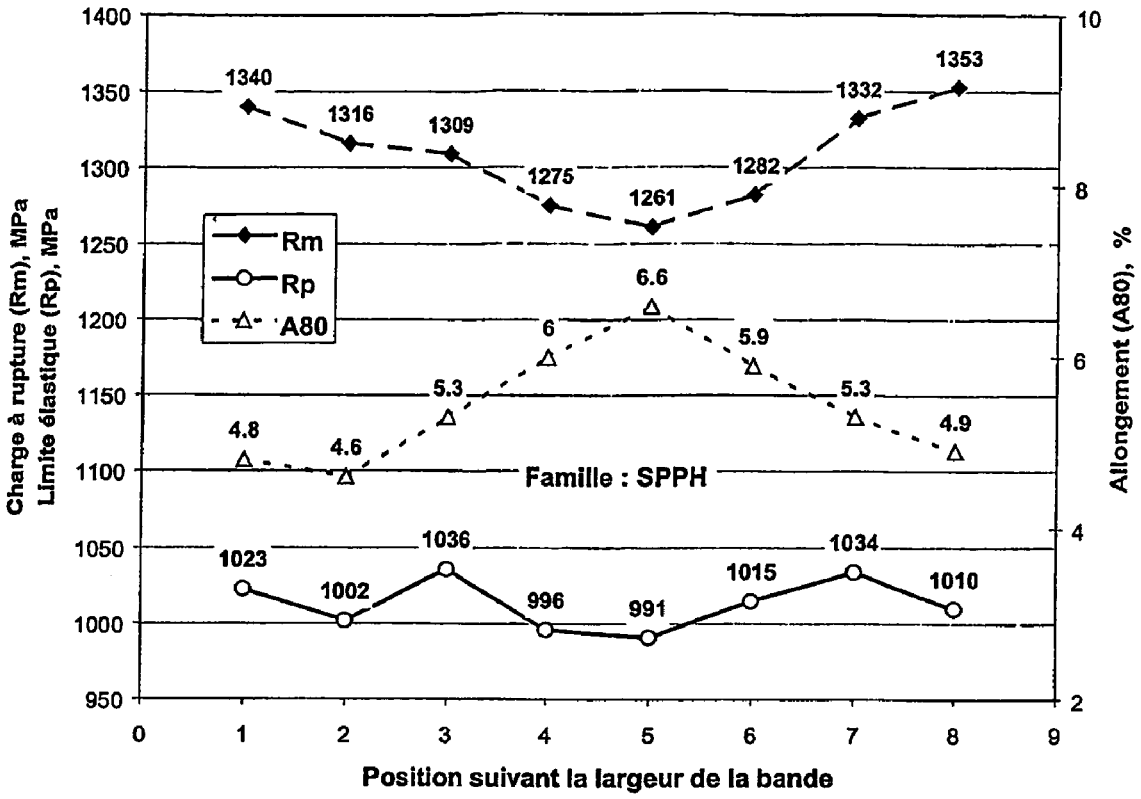
Figure 7:
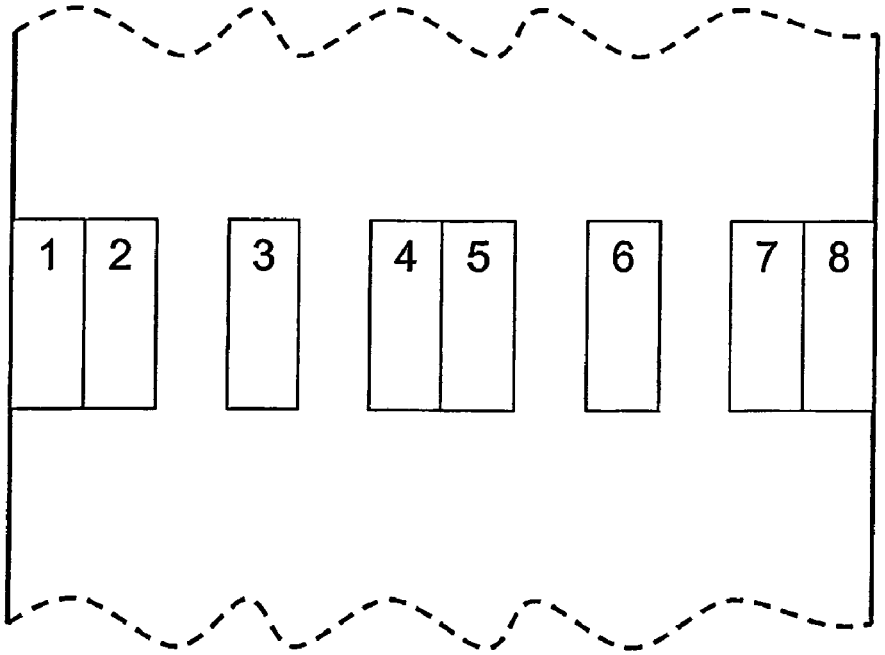
FIG. 7 schematically shows the different positions of the samples taken as a function of the width of the strip to carry out trials relating to FIGS. 5 and 6.

FIGS. 5 and 6 show the impact of the cooling uniformity on the homogeneity of mechanical properties. FIG. 5 relates to a steel of the "dual phase" family. FIG. 6 relates to a multiphase steel (ferrite, martensite, bainite, perlite). In both cases, the mechanical properties are determined by a traction test. The samples are taken at different positions depending on the width of the sheet, according to the scheme shown in FIG. 7:

1) extreme edge
2) edge
3) quadrant
4) centre
5) centre
6) quadrant
7) edge
8) extreme edge FIGS. 5 and 6 show respectively represent the breakpoint load, the elastic limit (FIG. 6 only) and the elongation at 80% of the breakpoint load. It may be concluded from these observations that there is good homogeneity of the mechanical properties along the width of the strip.

The invention claimed is:

1. Cooling device for a quenching operation during the continuous annealing treatment of a flat product in the form of a metal strip (2), preferably a steel strip, said device:

being located in an essentially vertical, ascending or descending path;

comprising an overflow weir (4) in which a series of tubes (1) are completely immersed and stacked more or less vertically and symmetrically along each side of the strip (2) and which each eject onto the strip a cooling fluid in the form of essentially horizontal turbulent jets through a slit or a series of holes;

being provided in its lower part with a sealing means (3); characterised in that any two successive tubes (1) located on a same side of the strip (2) are separated by a gap (B) serving as an evacuation passage of the cooling fluid, said gap being identical for all tubes (1), chosen at a given value of specific flow rate of the cooling fluid, expressed in cubic meters per hour and per square meter of a surface of the strip so as to minimise the loss of flow in the evacuation passages corresponding to said gap (B).

2. Device according to claim 1, characterised in that the wall of the overflow weir (4), located at the back of the tubes (1), has a width at least equal to that of the tubes (1) and the horizontal distance of this wall relative to the back of the tubes (1) is selected so that the loss of flow caused by the presence of the overflow weir (4) is less than 5% of the loss of flow caused by the gaps (B) between two successive tubes (1).

3. Device according to claim 1, characterised in that the distance (A) between the end of each tube (1) and the strip (2) is identical for all tubes and is between 20 mm and 200 mm.

4. Device according to claim 1, characterized in that said tubes (1) have a rectangular section.

5. Device according to claim 1, characterised in that said sealing means (3) comprises a lock with pairs of rollers that allow both the passage of the strip (2) and the creation of a loss of flow limiting to a minimum value the leaks from the overflow weir (4) downwards, and a means for injecting a fluid between said pairs of rollers, with control of the pressure and/or temperature.

* * * * *